United States Patent [19]

Jonsson et al.

[11] Patent Number: 4,570,664

[45] Date of Patent: Feb. 18, 1986

[54] VENTING DEVICE FOR OIL-BURNING INSTALLATIONS

[75] Inventors: Nils I. Jonsson, Furulund; Lars E. Hedenstierna, Lund, both of Sweden

[73] Assignee: EMA Instrument AB, Malmo, Sweden

[21] Appl. No.: 681,901

[22] Filed: Dec. 14, 1984

[30] Foreign Application Priority Data

Dec. 15, 1983 [SE] Sweden ..... 8306747

[51] Int. Cl.[4] ..... F04B 41/00

[52] U.S. Cl. ..... 137/202; 137/207; 417/299; 417/304; 431/89

[58] Field of Search ..... 431/29, 89; 417/299, 417/304; 137/202, 207

[56] References Cited

FOREIGN PATENT DOCUMENTS 341231 12/1971 Sweden .

*Primary Examiner*—Carroll B. Dority, Jr.

*Attorney, Agent, or Firm*—Cushman, Darby & Cushman

[57] ABSTRACT

The invention relates to a venting device for oil-burning installations. A float arranged in a venting chamber controls both a connection between the venting chamber and the surrounding atmosphere and a connection between the venting chamber and the suction side of an oil pump included in the installation.

4 Claims, 2 Drawing Figures

VENTING DEVICE FOR OIL-BURNING INSTALLATIONS

The present invention relates to a venting device for oil-burning installations of the type comprising an oil supply pipe from an oil tank, a pump and a burner, a return pipe being arranged between the pump and the burner for feeding part of the oil back to the suction side of the pump, said venting device being mounted in said return pipe and having a venting chamber with a float-controlled vent orifice.

In known venting devices, oil is supplied from the pump to the venting chamber via a nonreturn valve, and the connection between the venting chamber and the suction side of the pump is controlled by a pressure valve which does not open until the venting chamber has been pressurised and the vent orifice has closed.

The object of the present invention is to provide a reliable venting device in which communication between the venting chamber and the suction side of the pump can be established also when the pressure in the venting chamber has been relieved.

This object is achieved in that the float controlling the vent orifice also controls a bottom valve provided in the venting chamber.

Figure 1:
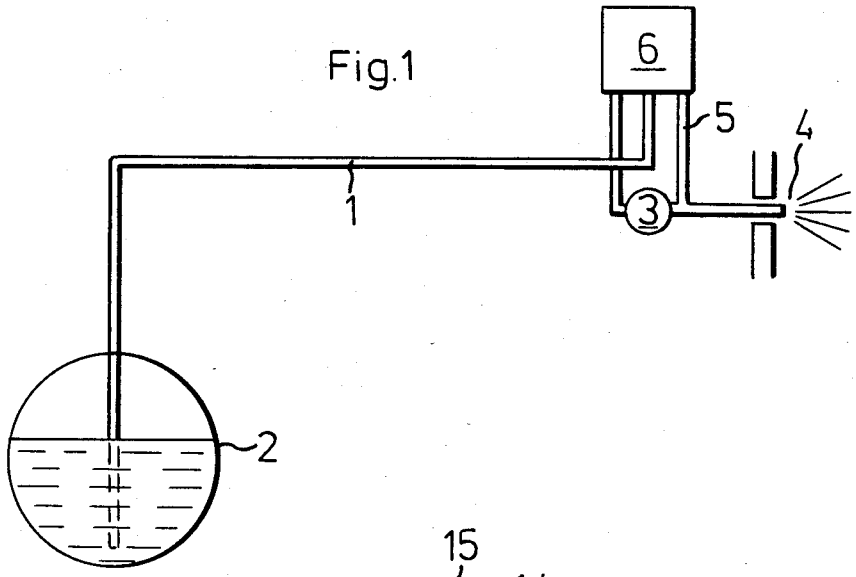
Figure 2:
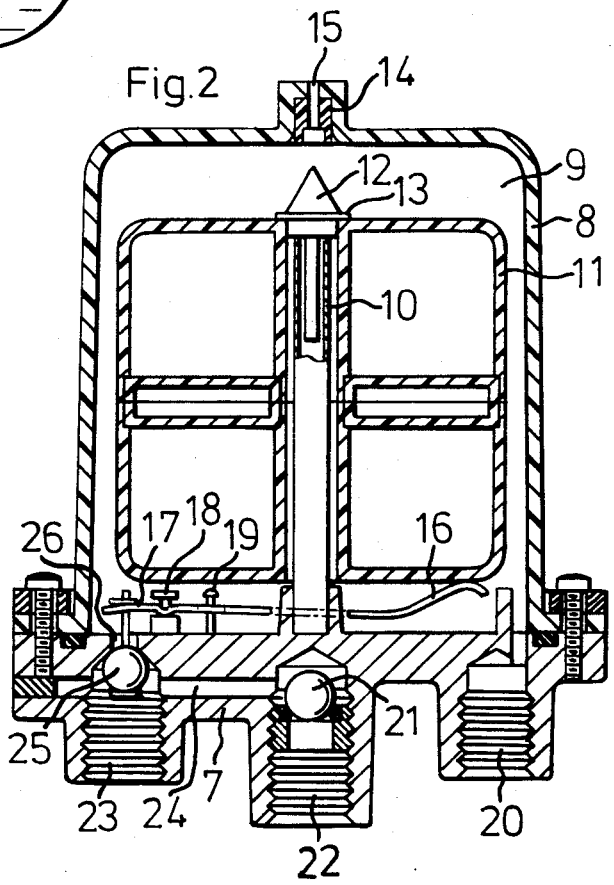

The invention will be described in detail below, reference being had to the accompanying drawing in which:

FIG. 1 shows schematically an oil-burning installation provided with a venting device, and FIG. 2 is a vertical section of a venting device according to the invention.

The arrangement shown in FIG. 1 comprises an oil supply pipe 1, an oil tank 2, a pump 3, and a burner 4. Between the pump 3 and the burner 4, a return pipe 5 is arranged to feed part of the oil back to the suction side of the pump 3. A venting device 6, as shown in detail in FIG. 2, is mounted in said return pipe 5.

The venting device shown in FIG. 2 has a base plate 7 to which a float housing 8 is attached. The base plate 7 and the housing 8 define a venting chamber 9.

A vertical, central guide pipe 10 is attached to the base plate 7 and guides a float 11 which, for reliability and simplicity of production, has been formed in two parts, each hermetically sealed. In the top end of the pipe 10, a valve member 12 is inserted which is axially movable in relation to the pipe 10 and which, by means of a shoulder 13, is taken along by the upward movement of the float 11. A valve seat 14 of, for example, plastic with a small valve orifice 15 is arranged centrally at the top of the float housing 8.

When the venting chamber 9 is empty, as shown in the drawing, the float 11 rests on one arm 16 of a lever 16, 17 rotatably mounted at 18. A pin 19 guides the movement of the lever 16, 17 in a defined vertical plane. The base plate 7 is provided with a first pipe socket 20 for connection to the pressure side of the pump 3, a second pipe socket 22 with a nonreturn valve 21, for connection to the oil tank 2, a third pipe socket 23 for connection to the suction side of the pump 3 as well as a connecting conduit 24 between said second and third pipe sockets 22 and 23, respectively.

A rubber ball 25 serving as valve member is suspended on the other arm 17 of the lever 16, 17 and controls an opening 26 of the venting chamber 9.

The venting device described above and shown in the drawing operates in the following manner:

The oil quantity supplied by the pump 3 to the burner 4 is considerably larger than the quantity which the burner 4 can receive. The excess quantity passes via the pipe 5 and the socket 20 to the venting chamber 9. When the oil in the venting chamber has reached the level where the float 11 begins to rise, the opening 26 opens and oil can now pass through the pipe socket 23 and the remainder of the pipe 5 to the suction side of the pump 3. The oil level in the venting chamber 9 then sinks, and the float 11 closes the opening 26. Oil can now be sucked from the tank 2 through the pipe 1, the pipe socket 22, the valve 21 and the conduit 24 to the suction side of the pump 3. In actual practice, some oil will always remain in the venting chamber 9. Normally, the latter is not under pressure, and therefore previously released air can easily be emitted through the orifice 15.

If the oil level in the venting chamber 9 for some reason increases abnormally, the float 11 urges the valve member 12 against the valve seat 14 and thus closes the orifice 15.

What we claim and desire to secure by Letters Patent is:

1. A venting device for oil-burning installations of the type comprising an oil supply pipe from an oil tank, a pump and a burner, a return pipe being arranged between the pump and the burner for feeding part of the oil back to the suction side of the pump, said venting device being mounted in said return pipe and having a venting chamber with a float-controlled vent orifice, characterised in that the float controlling the vent orifice also controls a bottom valve provided in the venting chamber.

2. A venting device according to claim 1, characterised in that the float in the empty venting chamber rests on one arm of a lever rotatably mounted in a vertical plane of the venting chamber, the other arm being attached to a movable valve member in said bottom valve.

3. A venting device according to claim 2, characterised in that said valve member is a rubber ball with a diameter larger than a bottom opening in the venting chamber, and is adapted to be urged against a valve seat around said opening at the bottom of the venting chamber.

4. A venting device according to claim 3, characterised in that the bottom of the venting chamber comprises a first pipe socket from the pressure side of the pump, a second pipe socket with a nonreturn valve, for connection to the oil tank, a third pipe socket arranged below the rubber ball for connection to the suction side of the pump as well as a connecting conduit between said second and third pipe sockets.

* * * * *